United States Patent [19]

Wytko

[11] 4,372,477

[45] Feb. 8, 1983

[54] CONTAINER

[75] Inventor: Richard Wytko, Olympia, Wash.

[73] Assignee: Weyerhaeuser Company, Tacoma, Wash.

[21] Appl. No.: 383,390

[22] Filed: Jun. 1, 1982

Related U.S. Application Data

[63] Continuation-in-part of Ser. No. 284,426, Jun. 20, 1981, abandoned.

[51] Int. Cl.[3] ..... B65D 5/10; B65D 5/22

[52] U.S. Cl. ..... 229/39 R; 229/34 R; 229/23 A

[58] Field of Search ..... 229/39 R, 37 E, 34 R, 229/34 A, 34 B, 41 R, 41 B, 44 R

[56] References Cited

U.S. PATENT DOCUMENTS

| | | | |
|---|---|---|---|
| 3,178,093 | 4/1965 | Wasyluka | 229/37 E |
| 3,493,722 | 10/1969 | Rahde | 229/37 R |
| 3,494,536 | 2/1970 | Henry | 229/39 R |
| 3,727,824 | 4/1973 | Giebel | 229/41 B |
| 3,861,581 | 1/1975 | Sellars | 229/34 R |
| 4,266,715 | 5/1981 | Garrison | 229/37 E |
| 4,266,716 | 5/1981 | Austin | 229/39 R |

FOREIGN PATENT DOCUMENTS

| | | | |
|---|---|---|---|
| 2805356 | 8/1979 | Fed. Rep. of Germany | 229/34 R |

*Primary Examiner*—Herbert F. Ross

*Attorney, Agent, or Firm*—Weyerhaeuser Company

[57] ABSTRACT

A container in which the container walls, the bottom closure and the reinforcing panels are unitary.

4 Claims, 8 Drawing Figures

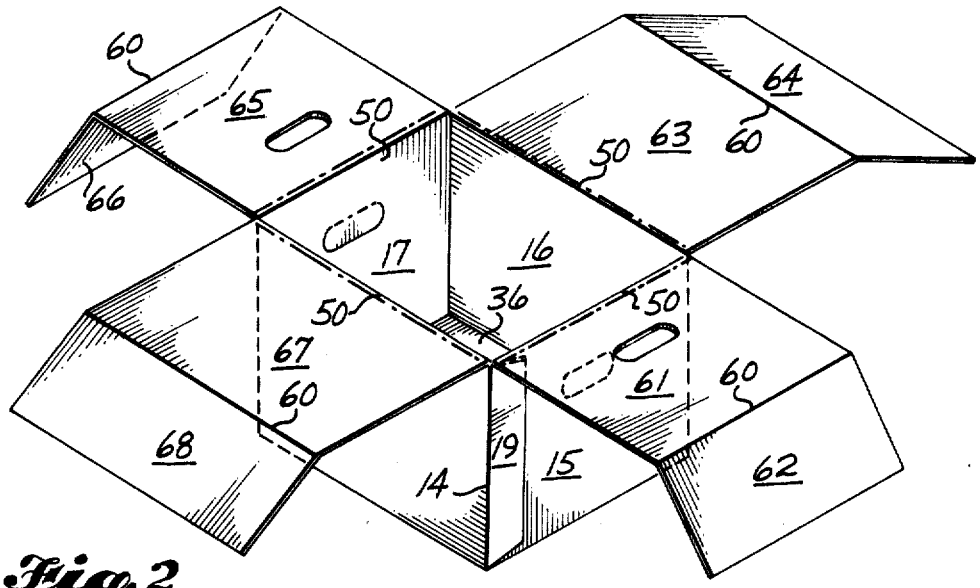
Fig. 2
Fig. 3
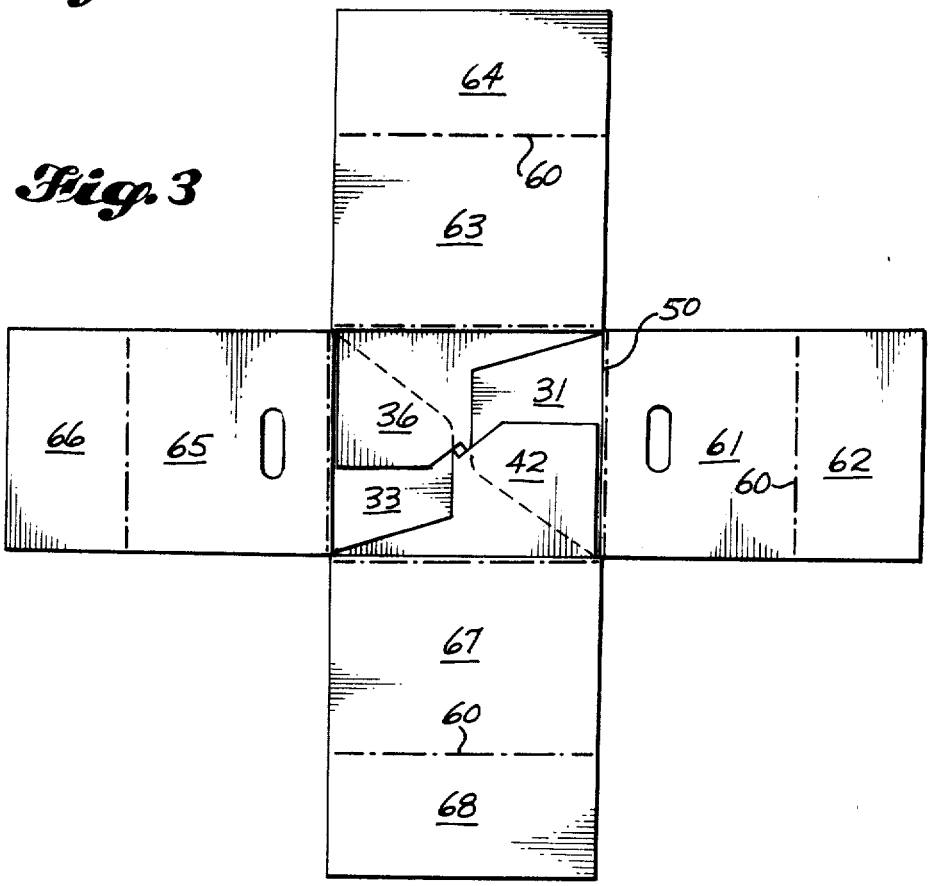

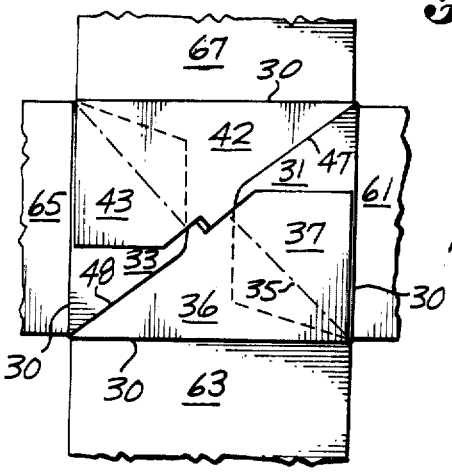
Fig. 4
Fig. 5
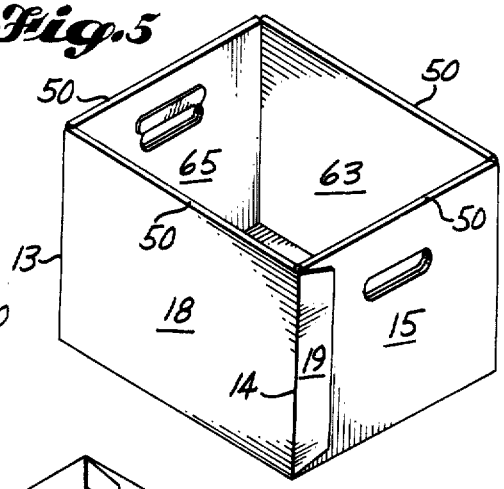
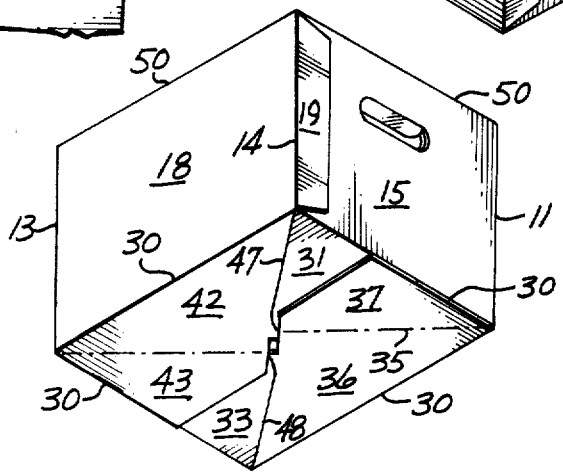
Fig. 6
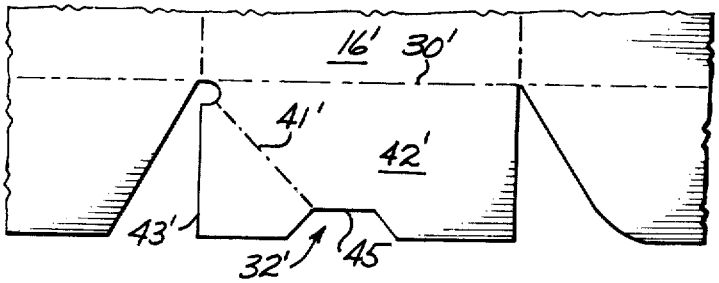
Fig. 7
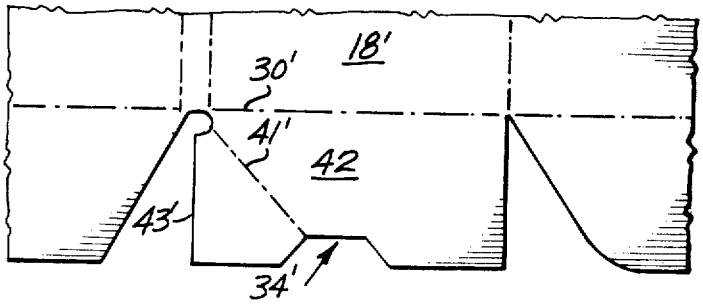
Fig. 8

CONTAINER

RELATED APPLICATION

This is a Continuation in Part of Application Ser. No. 284,426, filed June 20, 1981, now abandoned.

BACKGROUND OF THE INVENTION

1. Field of the Invention

A reinforced storage container.

2. Other Disclosures

There are many patents showing reinforced side walls on containers. Exemplary of these are Fleischer, U.S. Pat. No. 2,074,314 issued Mar. 16, 1937; Bronte, et al, U.S. Pat. No. 3,063,615, issued Nov. 13, 1962; Demby, et al, U.S. Pat. No. 3,285,492, issued Nov. 15, 1966; and Keith, U.S. Pat. No. 3,286,900, issued Nov. 22, 1966. Other patents disclose reinforcing around the upper rim of containers. Exemplary of these are Beaman, et al, U.S. Pat. No. 2,220,388, issued Nov. 5, 1940; and Wasyluka, U.S. Pat. No. 3,178,093, issued Apr. 13, 1965. Main, U.S. Pat. No. 2,675,166 issued Apr. 13, 1954 discloses a container in which the side walls are reinforced and the two end reinforcing walls are held in place by bottom flaps on the side reinforcing panels.

SUMMARY OF THE INVENTION

The present invention provides a container in which the container walls, the bottom closure, and the reinforcing panels are unitary. It also provides a container which may be shipped in lay-flat condition to the customer and stored in such condition until used. It may then be erected and formed without the aid of machinery.

This is particularly useful for shipping and storage containers such as small containers used by transfer and storage companies or record and file folder storage containers. These must be in inventory for use when needed, but are not an item that is regularly used. In all such instances, a large inventory must be kept on hand and the ability to store in a lay-flat condition reduces the space required for the containers. The fact that thecontainer and the reinforcing panels are unitary eliminates the usual problems of having and storing separate container and reinforcing elements.

These containers would be used occasionally and do not lend themselves to machine formation. They must easily be formed by hand. The present container has this capability.

BRIEF DESCRIPTION OF THE DRAWINGS

FIG. 2 is an isometric view of the erected container with the reinforcing panels not yet in place.

FIG. 3 is a top plan view of the container shown in FIG. 2.

FIG. 4 is a bottom plan view of the container shown in FIG. 2 with portions cut away to show details of construction.

FIG. 5 is an isometric view of the container with reinforcing panels in place.

FIG. 6 is an isometric view of the container from the bottom.

FIGS. 7-8 are top plan views, each showing a closure panel having a modified relief.

DESCRIPTION OF THE PREFERRED EMBODIMENT

Figure 1:
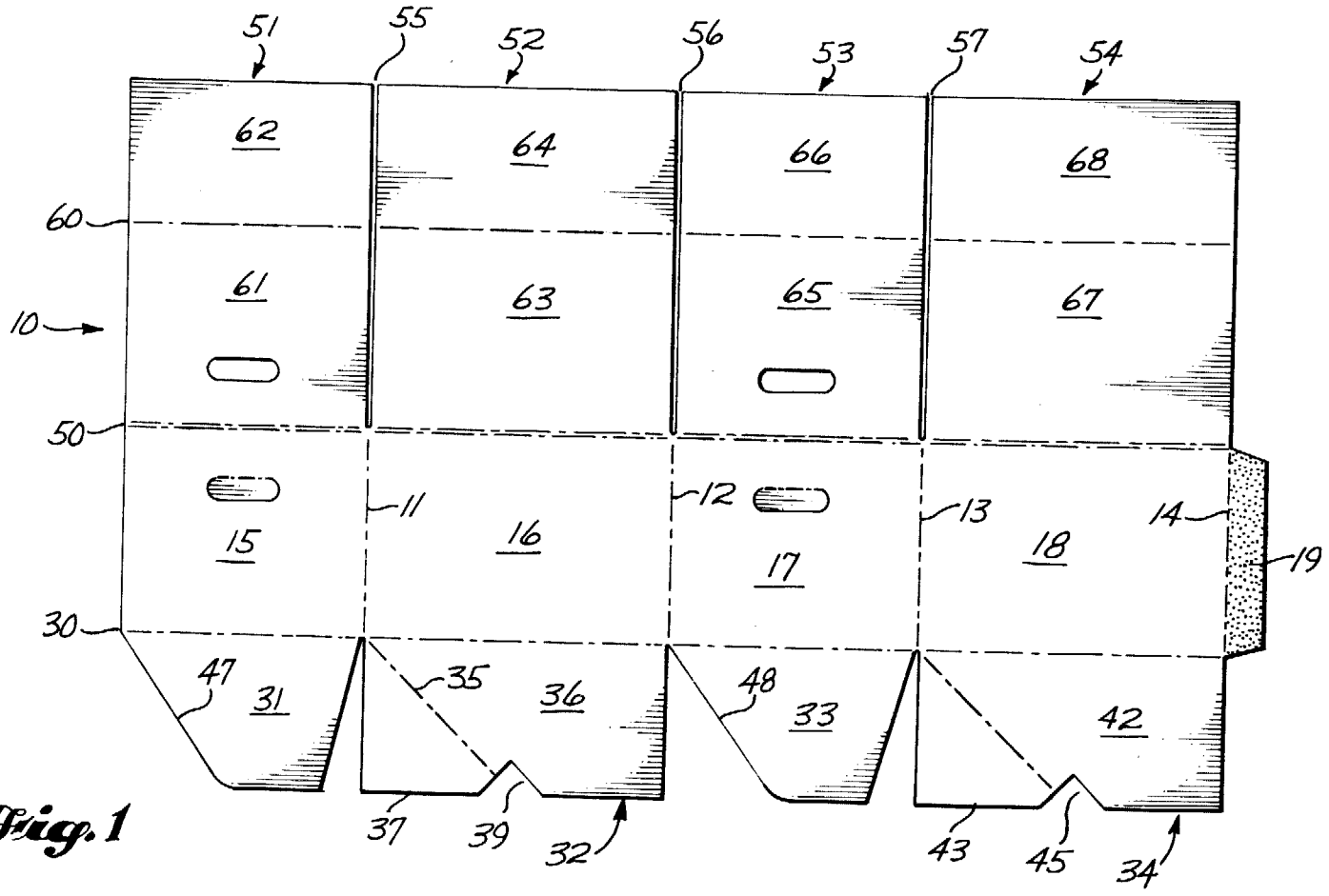
FIG. 1 is a top plan view of a blank for the container.

Blank 10 is divided by score lines 11, 12, 13 and 14 into a first side panel 15, a back panel 16, a second side panel 17, a front panel 18 and a glue flap 19. Score lines 11 and 13 are double score lines and score lines 12 and 14 are single score lines.

The score line 30 defines the lower edge of the first side panel 15, the back panel 16, the second side panel 17 and the front panel 18. The bottom closure panels of the container are hinged to these panels along the score line 30 - the bottom closure panel 31 being hinged to first side panel 15, the bottom closure panel 32 being hinged to the back panel 16, the bottom closure panel 33 being hinged to second side panel 17 and the bottom closure panel 34 being hinged to front panel 18.

The style of bottom closure shown is a self-closing closure so that no additional tape or staples are needed to form it when the container is set up.

The bottom closure panel 32 is divided by a diagonal score line 35 into a main body section 36 and a fold back secton 37. The lower edge of bottom closure panel 32 has a triangular relief 39 at its approximate midpoint. Bottom closure panel 34 is divided by diagonal score line 41 into a main body section 42 and a fold back section 43. The lower edge of bottom closure panel 34 has a triangular relief 45 at its approximate midpoint. Glue is applied to a major portion of the fold back sections 37 and 43.

In forming the bottom section of the container, the bottom closure panels 31, 32, 33 and 34 are bent inwardly around score line 30 until they overlie the inner faces of the panels 15, 16, 17 and 18. The fold back section 37 is bent outwardly around score line 35 until it overlies the outer face of main body section 36, and the fold back section 43 is bent outwardly around score line 41 until it overlies the outer face of main body section 42. The panel 15 is then folded around score line 11 over the inner face of front panel 16. In this process, fold back panel 37 is adhered to the outer face of bottom closure panel 31. The front panel 18 is folded inwardly around score line 13 over the inner face of second side panel 17. In this process, fold back panel 43 is adhered to the outer face of bottom closure panel 33. During this latter process, the glue flap 19 is adhered to the outer face of first side panel 15 to form the lay-flat container.

When the front, side and back panels 15, 16, 17 and 18 of the container are squared to form the erect container shown in FIG. 2, the bottom closure panels 31, 32, 33 and 34 automatically form the bottom closure of the container because they are pulled downwardly around score line 30 into the plane of the score line 30. The bottom closure panels 31 and 33 are beveled along side edges 47 and 48 so they will slide along the opposite bottom closure panels and not hang up in the container during closure.

Other bottom closure configurations may be used.

FIG. 7 shows bottom closure panel 32' and FIG. 8 shows bottom closure panel 34'. Each is divided by diagonal score lines 41' into a main body section 42' and a fold back section 43'. The lower edge of panel 34' has a trapezoidal relief 45' at its approximate midpoint. Panel 32' would have a similar relief 39'. The reliefs 39' and 45' allow the interlocking of the bottom closure panels 32' and 34' when the container is erected to form an overlapping bottom panel section.

The reinforcing panels are attached to the upper edges of the panels 15, 16, 17 and 18 along the score line 50. The first side reinforcing panel 51 is hinged to the first side panel 15. The second side reinforcing panel 53 is hinged to the second side panel 17. The back reinforcing panel 52 is hinged to back panel 16, and the front reinforcing panel 54 is hinged to the front panel 18. The reinforcing panels 51, 52, 53 and 54 are separated from each other by slots 55, 56 and 57 which are in alignment with score lines 11, 12 and 13, respectively.

Each of the reinforcing panels is divided into two sections by score line 60. The first side reinforcing panel 51 is divided into a first side reinforcing section 61 and a first bottom reinforcing section 62. The back reinforcing panel 52 is divided into back reinforcing section 63 and second bottom reinforcing section 64. The second side reinforcing panel 53 is divided into a second side reinforcing section 65 and a third bottom reinforcing section 66. The front reinforcing panel 54 is divided into a front reinforcing section 67 and a fourth bottom reinforcing section 68.

After the container has been erected as shown in FIGS. 2, 3 and 4, the reinforcing sections are placed into the container as shown in FIG. 5.

The first and second side reinforcing panels 51 and 53 are first placed into the container. The first side reinforcing section 61 is contiguous with the first side panel 15 and the first bottom reinforcing section 62 extends along the bottom closure of the container. The second side reinforcing section 65 is contiguous with second side panel 17 and the third bottom reinforcing section 66 extends along the bottom closure of the container.

The back reinforcing panel 52 and front reinfocing panel 54 are then folded into the container. The back reinforcing section 63 is contiguous and substantially coextensive with the back panel 16, and the front reinforcing section 67 is contiguous and substantially coextensive with the front panel 18. The width of both back reinforcing section 63 and front reinforcing section 67 is slightly narrower than the back panel 16 or front panel 18 to allow them to be placed into the container between side reinforcing sections 61 and 65. Consequently, both are at least two material thicknesses narrower than either the back panel 16 or the front panel 18.

Both the second and fourth bottom reinforcing sections 64 and 68extend aong the bottom of the container over the first and third bottom reinforcing sections 62 and 66. In the panels 52 and 54, the score line 60 is offset from the score line 60 in panels 51 and 53 a distance that allows the second and fourth bottom reinforcing sections 64 and 68 to be over the first and third bottom reinforcing sections 62 and 66. Consequently , it is offset the width of the material forming the container.

The bottom reinforcing panels may be reversed. The second and fourth bottom reinforcing panel may be underneath the first and third bottom reinforcing panels.

In the present design, the blank is substantially rectangular. However, in some instances the first and third bottom reinforcing sections would be of a length that would allow them to meet in the middle of the container to provide a two-ply bottom closure. The second and fourth bottom reinforcing sections 64 and 68 could, if necessary, also be designed to meet in the middle of the container to provide a substantially three-ply bottom closure.

The usual material for this container is double walled corrugated.

I claim:

1. A container blank comprising first, second, third and fourth panels serially connected by first, second and third score lines, means for connecting said first and fourth panels in the completed container, two of said first, second, third and fourth panels being opposed side walls in the erect container, the other two of said first, second, third and fourth panels being opposed front and back panels in the erect container, bottom closure panels extending from selected lower edges of said first, second, third and fourth panels along a fourth score line, said bottom panels attached to said front and back panels each having a diagonal score line to form a fold back section and a converging relief at the midpoint of the outer free edge thereof, said diagonal score lines being parallel to each other and extending inwardly from said relief, said bottom panels attached to said side walls being truncated, a front reinforcing panel being hingedly attached along a fifth score line to the upper edge of said front panel, the length of said front reinforcing panel being substantially equal to the height of said front panel and the width of said front reinforcing panel being substantially equal to the width of said front panel, side reinforcing panels hingedly attached along said fifth score line to the upper edge of each of said side panels, said side reinforcing panels having a length substantially equal to the height of said side panels and a width substantially equal to the width of said side panels, a back reinforcing panel being hingedly attached to said back panel along said fifth score line, said back reinforcing panel having a length substantially equal to the height of said back panel and a width substantially equal to the width of said back panel, bottom reinforcing panels attached to the outer edge of said reinforcing panels along a sixth score line, each said bottom reinforcing panel being rectangular and of equal length extending from said sixth score line to a distance which when the carton blank is erected the opposed bottom reinforcing panels will overlap each other.

2. A container comprising a first, second, third and fourth panels serially connected by score lines, means for connecting said first and fourth panels, two of said first, second, third and fourth panels being opposed side walls of the container, the other two of said first, second, third and fourth panels being opposed front and back walls of the container, a bottom closure extending along the lower edge of said first, second, third and fourth panels, said bottom closure including opposed truncated panels extending from said opposed side walls and opposed rectangular panels extending from said front and back walls respectively, each said rectangular panel extending beyond the major axis of the container bottom and includes a converging recess at the midpoint of its outer free edge and a diagonal score line extending inwardly from said recess thereby forming a fold back section, said fold back sections adhesively secured to the adjacent truncated panel, said bottom panel being secured with the engagement of said recesses, a front reinforcing panel hingedly attached to the upper edge of said front panel extending into said container in contact with the inner face of said front panel, side reinforcing panels hinged to the upper edges of said side panels and extending downwardly into the container in contact with the inner face of said side panels, and a back reinforcing panel hingedly attached to the upper edge of said back panel extending into said container in contact with the inner face of said back panel, and bottom reinforcing panels hinged to the lower edges of said front, back and side reinforcing panels, each said bottom reinforcing panel being rectangularly shaped and of equal length and extending normal to respctive front, back and side reinforcing panels a distance such that opposed bottom reinforcing panels overlap each other.

3. The container of claim 2 in which said side bottom reinforcing panels extend over the bottom closure and said front and back bottom reinforcing panels extend over said side bottom reinforcing panels.

4. The container of claim 2 in which said front and back bottom reinforcing panel extend along the bottom closure and said side bottom reinforcing panels extend over said front and back bottom reinforcing panels.

* * * * *